US007775902B2

(12) United States Patent
Churovich

(10) Patent No.: US 7,775,902 B2
(45) Date of Patent: Aug. 17, 2010

(54) GOLF CLUB CAPABLE OF DISASSEMBLY

(76) Inventor: Douglas D. Churovich, 11916 Paradise La., Des Peres, MO (US) 63131

( * ) Notice: Subject to any disclaimer, the term of this patent is extended or adjusted under 35 U.S.C. 154(b) by 0 days.

(21) Appl. No.: 11/788,648

(22) Filed: Apr. 20, 2007

(65) Prior Publication Data

US 2007/0249430 A1 Oct. 25, 2007

Related U.S. Application Data

(60) Provisional application No. 60/793,932, filed on Apr. 20, 2006.

(51) Int. Cl.
*A63B 53/10* (2006.01)
*A63B 53/12* (2006.01)

(52) U.S. Cl. ..... 473/296; 403/297

(58) Field of Classification Search ..... 473/288, 473/296–299, 307; 403/287, 297, 303–304, 403/314, 365, 109.3, 109.7; 135/75
See application file for complete search history.

(56) References Cited

U.S. PATENT DOCUMENTS

| | | | | | |
|---|---|---|---|---|---|
| 782,955 | A | | 2/1905 | Emens | |
| 796,802 | A | | 8/1905 | Brown | |
| 886,078 | A | * | 4/1908 | Rugg | 135/38 |
| 974,643 | A | * | 11/1910 | Carlson | 135/25.32 |
| 1,465,056 | A | * | 8/1923 | Phelan | 473/296 |
| 1,623,523 | A | * | 4/1927 | Bourke | 473/307 |
| 1,665,811 | A | | 4/1928 | Hadden | |
| 1,946,134 | A | | 2/1934 | Dyce | |
| 2,107,983 | A | * | 2/1938 | Hamilton | 473/296 |
| 3,685,135 | A | * | 8/1972 | Letters | 29/428 |
| 3,811,455 | A | * | 5/1974 | Thur | 135/25.4 |
| 3,829,092 | A | * | 8/1974 | Arkin | 473/288 |
| 4,044,784 | A | * | 8/1977 | Smith | 135/67 |
| 4,253,666 | A | * | 3/1981 | Murphy | 473/288 |
| 4,340,227 | A | | 7/1982 | Dopkowski | |
| 4,597,577 | A | | 7/1986 | Lamanna | |
| 4,721,125 | A | * | 1/1988 | Wang-Lee | 135/69 |
| 4,852,782 | A | | 8/1989 | Wu et al. | |
| 4,858,633 | A | * | 8/1989 | Yang | 135/25.4 |
| 5,282,619 | A | | 2/1994 | Napolitano et al. | |
| 5,433,442 | A | | 7/1995 | Walker | |
| 5,722,901 | A | * | 3/1998 | Barron et al. | 473/305 |
| 5,775,352 | A | * | 7/1998 | Obitts | 135/69 |

(Continued)

FOREIGN PATENT DOCUMENTS

| | | |
|---|---|---|
| GB | 325677 | 2/1930 |
| GB | 376474 | 7/1932 |

*Primary Examiner*—Stephen L. Blau
(74) *Attorney, Agent, or Firm*—Polster Lieder Woodruff & Lucchesi, L.C.

(57) ABSTRACT

A separable or collapsible golf club, comprising a first shaft member and a second shaft member, which are secured together by means of a connector having two or more biased releasable ring-shaped fasteners positioned apart from one another to provide counterbalanced engagement, to afford an interconnection of the shaft members to form a single golf club when assembled, but that allows for prompt disconnection, through the remote actuation of the fasteners, when the golf club members are to be separated or collapsed, or a different club head is to be installed for usage and application for driving or putting of a golf ball.

9 Claims, 5 Drawing Sheets

U.S. PATENT DOCUMENTS

| | | | | |
|---|---|---|---|---|
| 5,778,914 | A * | 7/1998 | Trani | 135/66 |
| 5,792,006 | A | 8/1998 | Hesser | |
| 6,343,997 | B1 * | 2/2002 | Allen | 473/212 |
| 6,447,404 | B1 | 9/2002 | Wilbur | |
| 6,547,673 | B2 * | 4/2003 | Roark | 473/239 |
| 6,743,116 | B2 * | 6/2004 | Wilbur | 473/296 |
| 6,746,341 | B1 * | 6/2004 | Hamric et al. | 473/288 |
| 6,749,521 | B1 * | 6/2004 | Benson | 473/239 |
| 6,782,903 | B1 * | 8/2004 | Jarman et al. | 135/75 |
| 6,890,269 | B2 * | 5/2005 | Burrows | 473/307 |
| 7,077,760 | B2 * | 7/2006 | Gray | 473/313 |
| 2002/0022533 | A1 * | 2/2002 | Churovich et al. | 473/296 |
| 2002/0082103 | A1 * | 6/2002 | Benson | 473/239 |
| 2005/0079923 | A1 | 4/2005 | Droppleman | |
| 2006/0040762 | A1 * | 2/2006 | Chupka et al. | 473/293 |

* cited by examiner

GOLF CLUB CAPABLE OF DISASSEMBLY

CROSS REFERENCE TO RELATED APPLICATIONS

This application claims the benefit of U.S. Provisional Application No. 60/793,932, entitled GOLF CLUB CAPABLE OF DISASSEMBLY, filed on Apr. 20, 2006. The disclosure of the above application is incorporated herein by reference.

STATEMENT REGARDING FEDERALLY SPONSORED RESEARCH OR DEVELOPMENT

Not applicable.

BACKGROUND OF THE INVENTION

This disclosure relates principally to a golf club, and more particularly to a golf club that can be readily separated or collapsed, to facilitate, for example, the transport of a set of clubs during travel.

Innovations to golf clubs have been made since the inception of the sport, and even the concept of reducing the size of the clubs, to facilitate their transit, has been considered. A number of configurations have been patented. However, owing to the tactile sensitivity of the human hand, previous configurations of collapsible and separable golf club designs are unsatisfactory due to the sensation of "wobble" or "rattle" that can be felt originating from the joining mechanisms of such existing designs. Existing designs that overcome this problem suffer from other shortcomings, including for example complexity or inconvenience of use. Further, existing clubs lack any independent or remote form of actuation of the separation feature, where such actuation may facilitate ease or convenience of disassembly and assembly of the club.

As will become evident in this disclosure, the present disclosure provides benefits over the existing art.

BRIEF DESCRIPTION OF THE DRAWINGS

The illustrative embodiments of the present disclosure are shown in the following drawings which form a part of the specification.

Corresponding reference characters indicate corresponding parts throughout the several views of the drawings.

DETAILED DESCRIPTION

Figure 1:
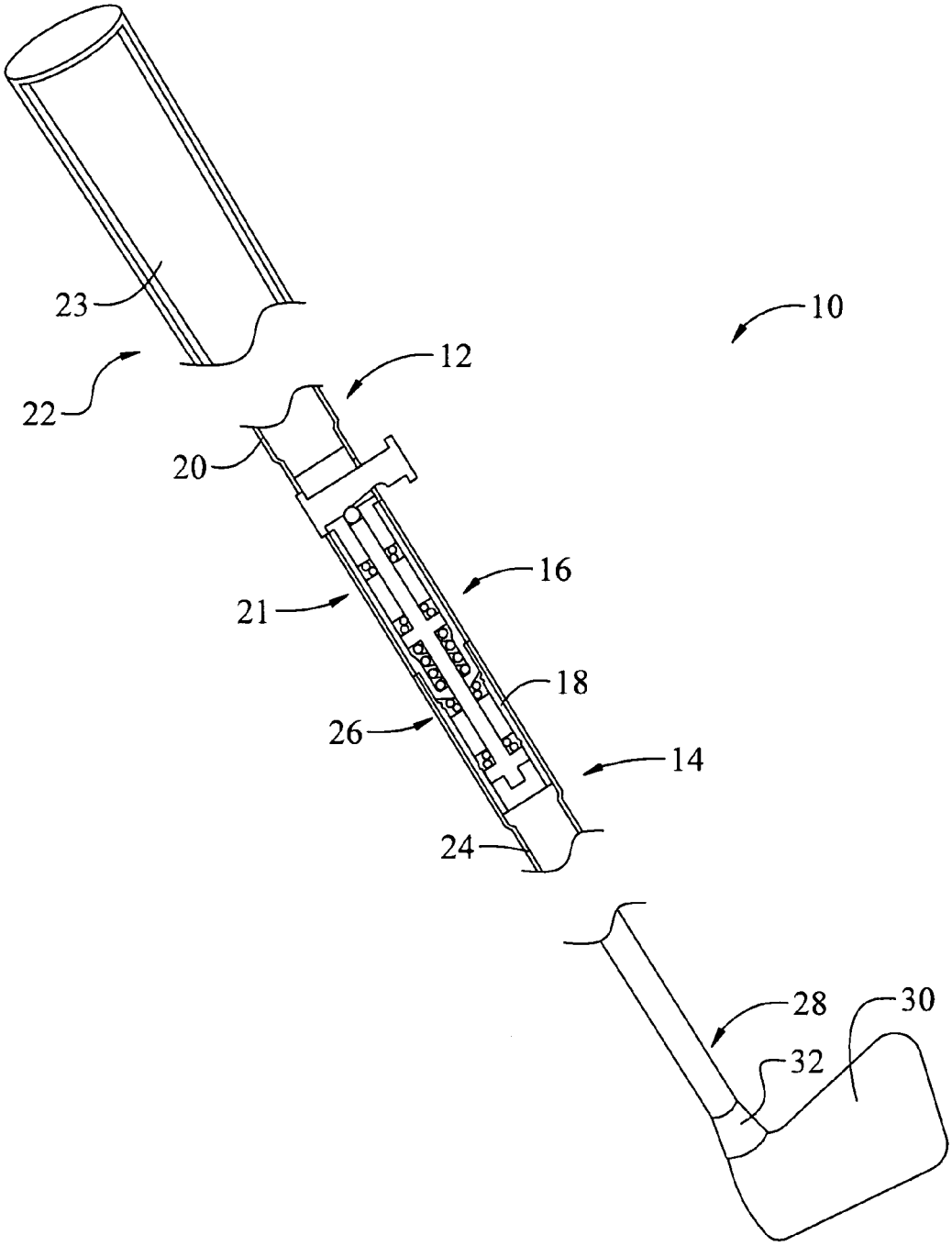
FIG. 1 is a side view of the entire golf club of a first embodiment of the present disclosure.

In referring to the drawings, an illustrative separable configuration embodiment of the novel golf club 10 of the present invention is shown generally in FIG. 1 in an assembled condition. A second and alternate configuration of the golf club of the present invention can be seen in FIGS. 8 and 9. Both the first and second embodiments are separable configurations. The golf club 10 (FIG. 1) includes a first hollow shaft portion 12 and a second hollow shaft portion 14, and a connector 16 positioned within and fixedly attached to the first shaft portion 12. The connector 16 (FIG. 6) has an exposed end X and a captured end Y. A sleeve 18 (FIG. 1) is positioned within and fixedly attached to the second shaft portion 14. The sleeve 18 (FIG. 5) includes a bore 19 defined by an inner sidewall with an opening or mouth Z at the proximal end of the second shaft portion 14. When the golf club 10 is fully assembled (FIG. 3), the exposed end X of the connector 16 extends through the mouth Z of the sleeve 18, and is thereby positioned within the first shaft portion 12, while the captured end Y is fixedly engaged within the second shaft portion 14 as shown. Moreover, in this embodiment, the lengths of the first and second shaft portions 12 and 14 are only slightly different, such that the connector 16 is located substantially midway along the length of the shaft of the assembled club 10. Of course, in alternate embodiments the connector 16 may be positioned at other points along the length of the shaft.

The first shaft member 12 includes an upper shaft segment 20 having a proximal end 21 and a distal end 22, and a grip 23. The grip 23 is constructed of rubber, leather or other such material to enhance the user's ability to grasp the golf club 10. The grip 23 is stretched over and firmly attached to the distal end 22 of the upper shaft segment 20, and may be adhered with adhesives, tape or other such common products. The second shaft member 14 includes a lower shaft segment 24 having a proximal end 26 and a distal end 28, and a club head 30 fixedly attached to the distal end 28 of the shaft segment 24. A ferrule 32 is positioned between the shaft segment 24 and the club head 30. In this embodiment, the first and second shaft members 12 and 14 are both formed of plated stepped steel golf club shaft stock in which the diameter of the upper shaft segment 20 of the first shaft member 12 increases in generally discrete increments along its length from its proximal end 21 to its distal end 22, and the diameter of the shaft segment 24 of the second shaft member 14 increases in generally discrete increments along its length from its distal end 28 to its proximal end 26. Of course, the present disclosure is not limited to using a stepped shaft or a shaft constructed of plated steel. Rather, the shaft may be straight, tapered or elongated in any other manner, so long as the connector 16 is capable of being adapted to fit within the first shaft member 12. Further, the shaft may be comprised of any number of materials or alloys or combinations of materials, including without limitation titanium, aluminum, chromoly, carbon or plastic fiber, or fiberglass.

Figure 2:
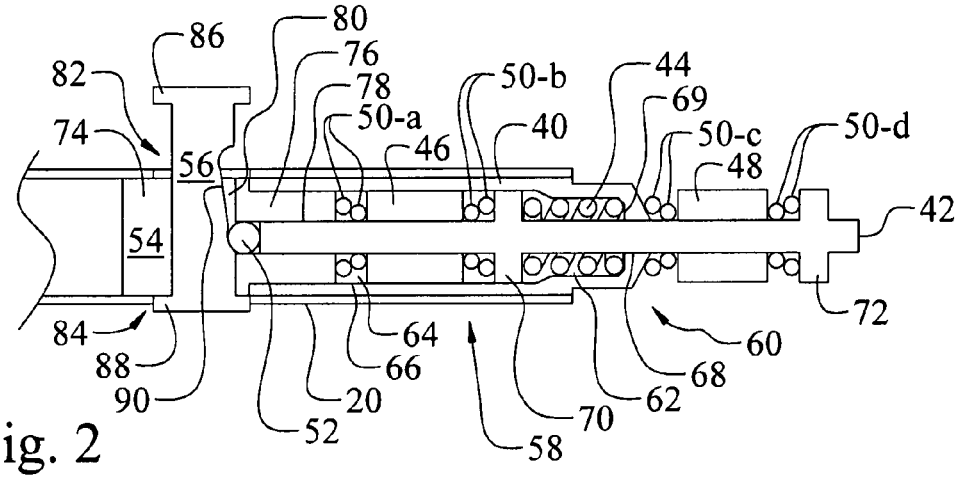
FIG. 2 is a cross sectional view of the upper section of the disassembled golf club in the vicinity of the connector of the first embodiment of the present disclosure.

An enlarged image of the connector 16 isolated from the second shaft member 14 is shown in FIG. 2. In this embodiment, the connector 16 includes a generally cylindrical body 40, a rod 42 positioned within the body 40, a biasing member comprising a compression spring 44, a first bushing 46, a second bushing 48, four fasteners 50 each comprising a set of elastic rings 50*a*, 50*b*, 50*c* and 50*d*, a ball bearing 52, an end plug 54 and a remote actuator button 56. The spring 44, the bushings 46 and 48, and the four fasteners 50 are all positioned about and substantially axially aligned with the rod 42. The body 40 has a captured end Y and an exposed end X. A first bore 62 is formed within the body 40. The first bore 62 opens into a larger second bore 64 defined by a sidewall 66 that extends through the captured end Y of the body 40. A smaller bore 68 extends from the first bore 62 opposite the bore 64, through the exposed end X of the body 40. An endwall 69 is formed at the juncture between the bores 62 and 68, the endwall 69 being generally perpendicular to the axis of the bores 62, 64 and 68. All three bores 62, 64 and 68 are coaxial with one another and with the body 40.

The rod 42 has two cylindrical lugs 70, 72 that are coaxial with and extend radially from the center of the rod 42. The lugs 70, 72 form movable sidewalls for compression of the fasteners 50, as will be described herein. These lugs 70, 72 and the rod 42 may be formed of the same stock material, or may be formed of different pieces of material that are rigidly attached together to facilitate manufacture and assembly. The diameter of the bore 64 is slightly greater than the diameter of the lug 70. The diameter of the bore 68 is slightly greater than the diameter of the rod 42. The rod 42 is positioned partially within the body 40 such that the lug 70 is located within the bore 64, the rod 42 extends out of the exposed end X of the body 40 through the bore 68, and the lug 72 is located outside the body 40. One skilled in the art will readily recognize that the rod 42 can move laterally along the length of the body 40 for a limited distance while essentially maintaining a generally coaxial relationship with the bores 62, 64 and 68.

The spring 44 is configured and positioned to surround the rod 42 while fitting within the bore 62 of the body 40. The spring 44 is further sized to be under constant partial compression when within the bore 62. As can readily be seen, the spring 44 is constrained by the lug 70 of the rod 42 at one end and the endwall 69 of the bore 62 at the other end. The end plug 54 is formed of two coaxial cylindrical portions 74 and 76, wherein the cylindrical portion 76 is smaller in diameter than the cylindrical portion 74. A bore 78 runs through and is coaxial with the center of the cylindrical portion 76. The diameter of the bore 78 is slightly larger than the diameter of the rod 42 such that the rod 42 may slide through the bore 78 as shown. The bore 78 opens inside the end plug 54 at a bore 80 that runs perpendicular to the bore 78 and the axis of the cylindrical portions 74 and 76. The bore 78 houses the bearing 52, the bearing 52 being sized to fit within the bore 78 such that the bearing 52 may rotate freely within said bore with a minimal amount of horizontal or lateral freeplay. The cylindrical portion 76 of the end plug 54 is sized to fit within the bore 64 in the body 40 where said cylindrical portion 76 is fixedly secured. The cylindrical portion 74 of the end plug 54 is sized to fit within the upper shaft segment 20 where said cylindrical portion 74 is fixedly secured. Bores 82 and 84, each having the same diameter as the bore 80, are formed in the side of the upper shaft segment 20 and positioned to align with each end of the bore 80 when the connector 16 is positioned within the upper shaft segment 20 as shown.

The remote actuator button 56 is generally cylindrical in shape with two plates 86 and 88 on each end, and a slot 90 along a portion of its length. The actuator 56 is sized to fit within and is positioned to run through and is coaxial with the bore 80 of the end plug 54, with the slot 90 facing the bore 78 in the end plug 54. The diameter of the bore 80 is slightly larger than the diameter of the actuator 56, and the outer dimensions of the plates 86 and 88 extend beyond the diameter of the bore 80 and thereby act as stops, such that the actuator 56 may slide through the bore 80 as shown up to the limits set by the plates 86 and 88. The slot 90 is formed in the shape of a trough and sized to accommodate the bearing 52.

As can be readily understood, the spring 44 applies constant pressure against the rod 42, which causes the rod 42 to remain in contact with the bearing 52. When the actuator 56 slides along the length of the bore 80, the bearing 52 will roll along the slot 90, thereby urging the rod 42 to move toward the spring 44 as the slot 90 becomes more shallow (FIG. 3), or alternatively allowing the rod 42 to move away from the spring 44 as the slot 90 becomes deeper (FIG. 4).

Returning to FIG. 2, the bushing 46 is positioned about the rod 42 between the end plug 54 and the lug 70 of the rod 42. The bushing 46 is sized to fit closely to the rod 42 while allowing for free movement along the rod. The bushing 46 is further sized to fit within the bore 64 of the body 40. The elastic rings 50*a* are positioned about the rod 42 between the end plug 54 and the bushing 46. The elastic rings 50*b* are positioned about the rod 42 between the bushing 46 and the lug 70 of the rod 42.

The bushing 48 is positioned about the rod 42 between the exposed end X of the body 40 and the lug 72 of the rod 42. The bushing 48 is sized to fit closely to the rod 42 while allowing for free movement along the rod. The bushing 48 is further sized to fit within the sleeve 18 (see FIGS. 1, 3, 5). The elastic rings 50*c* are positioned about the rod 42 between the exposed end X of the body 40 and the bushing 48. The elastic rings 50*d* are positioned about the rod 42 between the bushing 48 and the lug 72 of the rod 42.

The elastic rings 50*a-d* are spring metal and have a round cross-section, but are not complete circles. (see FIGS. 6, 7). Rather, each ring 50*a-d* forms a nearly complete circle with a split or gap 92 along the circumference. This configuration allows the rings 50*a-d* to expand or contract radially under pressure, and the spring properties of the rings 50*a-d* allow them to resume their original shape once such pressure is relieved. Such rings 50*a-d* are sometimes referred to in the spring industry as coiled retaining springs, round section rings, or wire rings. In each set of the rings 50*a-d* a large and a small ring are paired together. The rings in each set 50*a-d* bear a proportionate size relationship with each other, such that the inner diameter of the larger ring is less than the outer diameter of the smaller ring, and the core diameter (i.e. the diameter of the line that runs through the core of the wire forming the ring) of the smaller ring is less than that of the larger ring. In this way, and as can be readily understood by one of ordinary skill in the art, when the rings are compressed together laterally, the larger ring expands radially while the smaller ring constricts radially. This simultaneously imparts a force through the larger ring that is perpendicular to and directed away from the rod 42 and an equal force through the smaller ring that is directed toward the rod 42.

A bore 94 runs through the center of the sleeve 18 (FIG. 5), and two circular inner depressions or grooves 96 and 98 are formed within the bore 94 as shown. The bore 94 is sized to releasably accept the exposed end X of the connector 16. The grooves 96 and 98 are sized and shaped to accept the outer surface of the large rings in each of the ring sets 50*c* and 50*d*. When the connector 16 is slidably engaged within the sleeve 18 at the proximal end 26 of the lower shaft 24, the exposed end X of the connector 16 will extend into the bore 94 until the proximal ends 21 and 26 of the upper and lower shaft segments 20 and 24 meet. The grooves 96 and 98 will then be generally aligned with the ring sets 50*c* and 50*d*, such that when the actuator 56 is depressed to allow the ball bearing 52 to run deeper into the groove 90, thereby allowing the spring 44 to push the shaft 42 toward the button 56, the lug 72 will move toward the exposed end X of the connector 16 and axially compress both sets of rings 50*c* and 50*d*. When the sets of rings 50*c* and 50*d* are axially compressed by the lug 72, the smaller ring in each set compresses against the larger ring in each set. The smaller ring is thereby forced to compress inwardly against the shaft 42, while the larger ring in each set is forced to expand outwardly into and compress against the grooves 96 and 98 respectively. In this way, the axial compressive force from the spring 44 is converted into two sets of radially compressing and expanding forces at two discrete positions (through the sets of rings 50*c* and 50*d*) along the shaft 42 beyond the exposed end of the connector 16 that rigidly hold the rod 42 to the sleeve 18 and thereby to the lower shaft 24.

At the same time, the expansion of the spring 44 causes the lug 70 to compress the sets of rings 50*a* and 50*b* between the end plug 54 and the bushing 46 and the bushing 46 and the lug 70, respectively. When the sets of rings 50*a* and 50*b* are axially compressed by the lug 70, the smaller ring in each set compresses against the larger ring in each set. The smaller ring is thereby forced to compress inwardly against the shaft 42, while the larger ring in each set expands outwardly against the sidewall 66 of the bore 64 in the connector 16. In this way, the compressive force from the spring 44 is converted into two sets of radially compressing and expanding forces at two discrete positions along the shaft 42 within the connector 16 that rigidly hold the rod 42 to the connector 16 and thereby to the upper shaft segment 20.

As can be appreciated, the separation between the two sets of rings 50*a* and 50*b* in association with the bias provided by the spring 44 provides a spring-loaded counterbalance along the length of the connection between the first and second shaft members 12 and 14, to minimize the wobble of the club at the connection between the shaft members during use. This same spring-loaded counterbalance effect occurs with respect to the rings 50*c* and 50*d*. Hence, this novel feature of the present disclosure distributes the load from the bias member (here, the spring 44) among the fasteners 50. One of ordinary skill in the art will also appreciate that this load distribution minimizes the possibility of one fastener holding tight, while another fastener remains loose, which could produce an undesirable wobble during use of the club.

Figure 5:
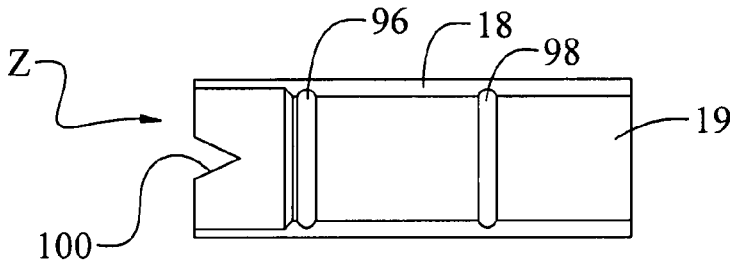
FIG. 5 is a cross sectional view of the sleeve that receives the connector of the golf club of the first embodiment of the present disclosure.
Figure 6:
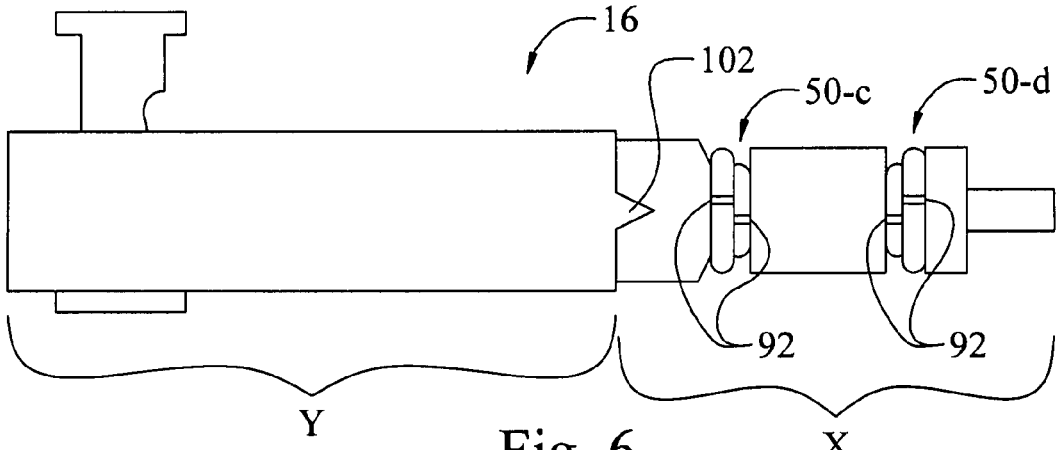
FIG. 6 is a side view of the connector of the golf club of the first embodiment of the present disclosure.
Figure 7:
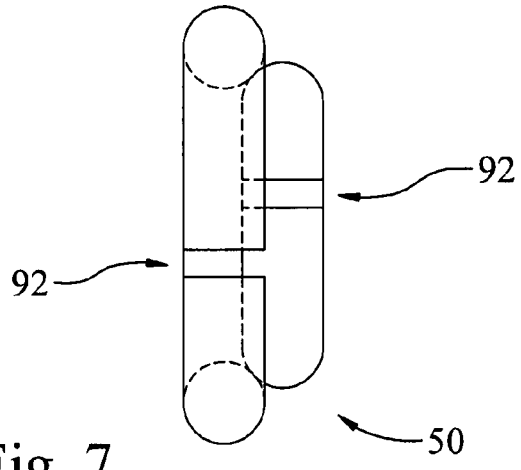
FIG. 7 is a side view of a paired set of elastic rings of the golf club of the first embodiment of the present disclosure, with broken lines showing certain internal features of the set of rings.

Referring to FIGS. 5 and 6, it can be seen that the sleeve 18 includes two wedge-shaped notches or locking surfaces 100 along the edge of the sleeve 18 that forms the mouth at that proximal end of the shaft member. In juxtaposition, two wedge-shaped protrusions or locking surfaces 102 extend from the captured end to the exposed end of the connector 16. The protrusions 102 are shaped to be received by and fit snugly within the notches 100 of the sleeve 18. Further, the protrusions 102 are positioned to mate with the notches 100 in such radial alignment about the central axis of the shaft so as to provide repeatable proper alignment the shaft member 12 with the shaft member 14 when the club 10 is fully assembled, while also preventing axial rotation of the shaft member 12 relative to the shaft member 14 during use of the club 10. The notches 100 and the locking surfaces 102 are not visible in any Figures other than FIGS. 5 and 6.

Figure 3:
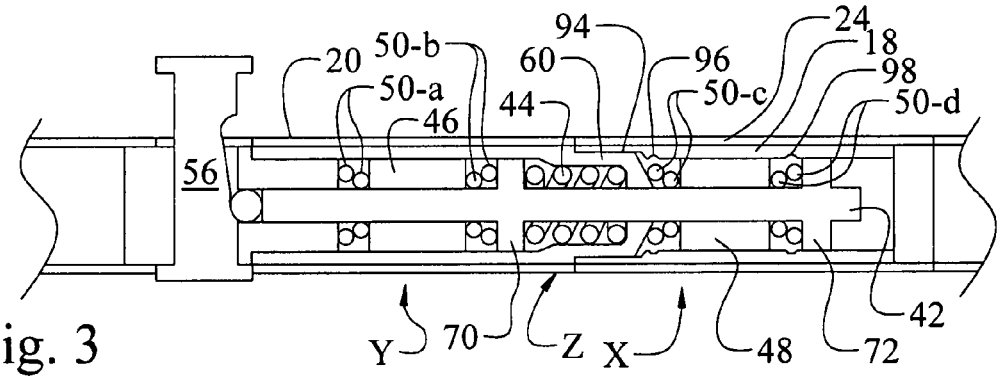
FIG. 3 is a cross sectional view of the assembled club in the vicinity of the connector for the first embodiment of the present disclosure.
Figure 4:
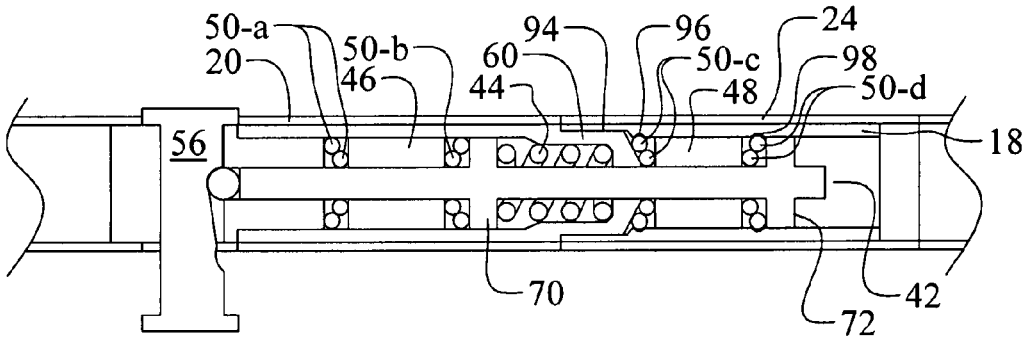
FIG. 4 is another cross sectional view of the assembled club in the vicinity of the connector for the first embodiment of the present disclosure.

Thus, as can be readily understood, when one desires to assemble the golf club 10 of the present disclosure, the actuator 56 must be depressed to the position shown in FIG. 3, thereby releasing the pressure on the rings 50 to provide sufficient clearance for the connector 16 to fit within the sleeve 18. The exposed end X of the connector 16 is then placed into the sleeve 18 such that the rings 50*c* and 50*d* align with the grooves 96 and 98 in the sleeve 18, and the protrusions 102 are aligned with and inserted into the notches 100. The actuator 56 must then be fully depressed in the opposite direction, to the position as shown in FIG. 4, to allow the spring 44 to compress the rings 50. In this way, sets of rings 50*a* and 50*b* forcibly engage the enclosed end of the shaft 42 with the sidewall 66 of the bore 64 in the connector 16, while simultaneously the sets of rings 50*c* and 50*d* forcibly engage the exposed end of the shaft 42 with the grooves 96 and 98 in the sleeve 18. The force of the spring 44 is thereby distributed among all the rings 50 causing the engagement of the two shaft members 12 and 14 together, and to a very tight securing relationship, for use for golfing purposes, as can be understood. In this way, the first and second shaft members 12 and 14 can be readily and repeatably assembled to form a complete club.

As can also be appreciated, the separation between the sets of rings 50*a* and 50*b* prevents, or at least minimizes, the occurrence of the wobble phenomenon between the rod 42 and the bore 64 that may result, for example, from a single point contact. Similarly, the separation between the sets of rings 50*c* and 50*d* prevents, or at least minimizes, the occurrence of the wobble phenomenon between the exposed end of the rod 42 and the sleeve 28 that may result, for example, from a single point contact.

To disassemble the assembled club 10, the user need only depress the actuator 56 to the position shown in FIG. 3, thereby releasing the pressure on the rings 50. This action disengages the enclosed end of the shaft 42 from the sidewall 66 of the bore 64 in the connector 16, and simultaneously disengages the exposed end of the shaft 42 from the sleeve 18. In this way, the first and second shaft members 12 and 14 can be readily and repeatably separated from one another.

Figure 8:
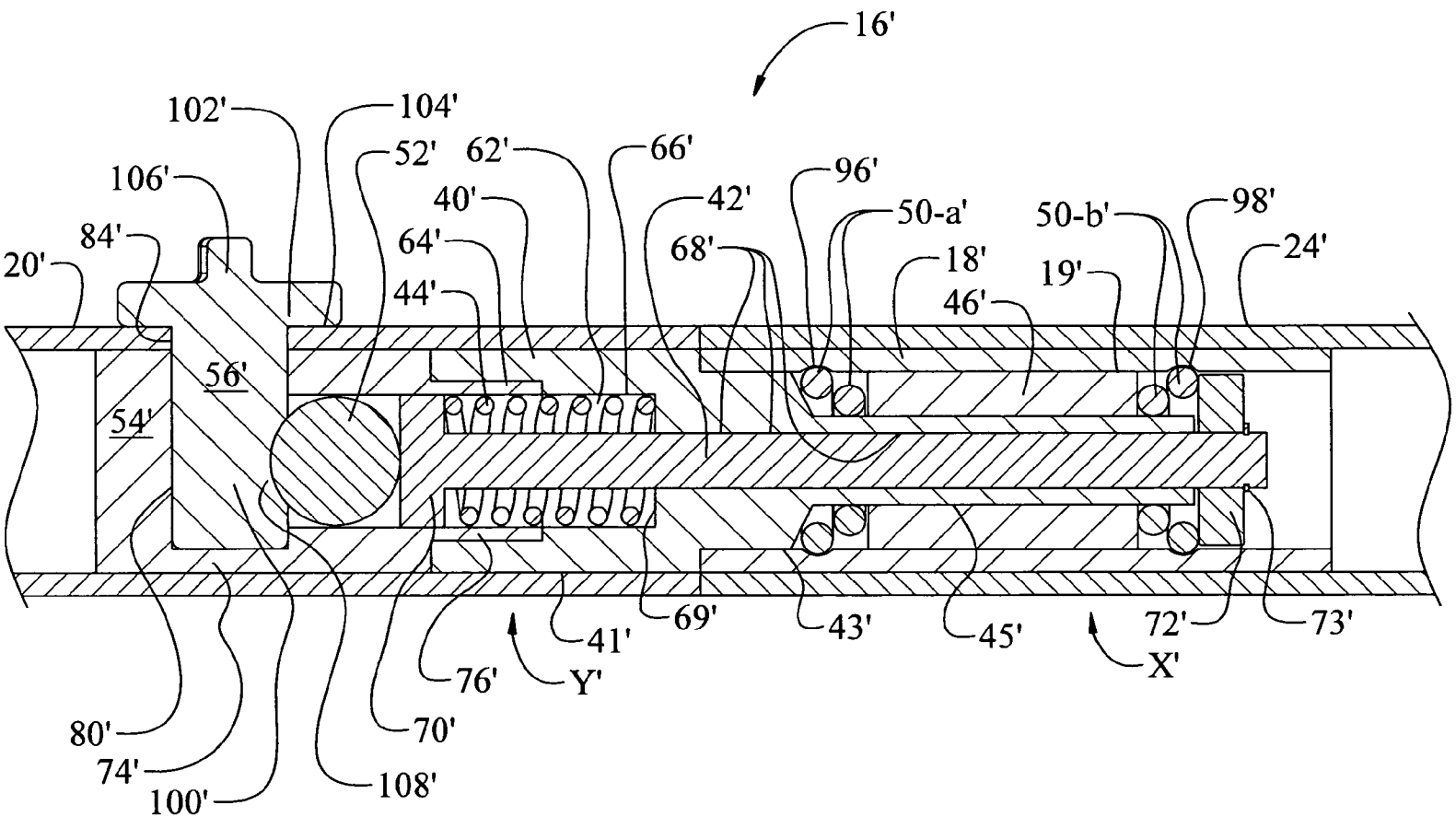
FIG. 8 is a cross sectional view of the connector of a second embodiment of the present disclosure.
Figure 9:
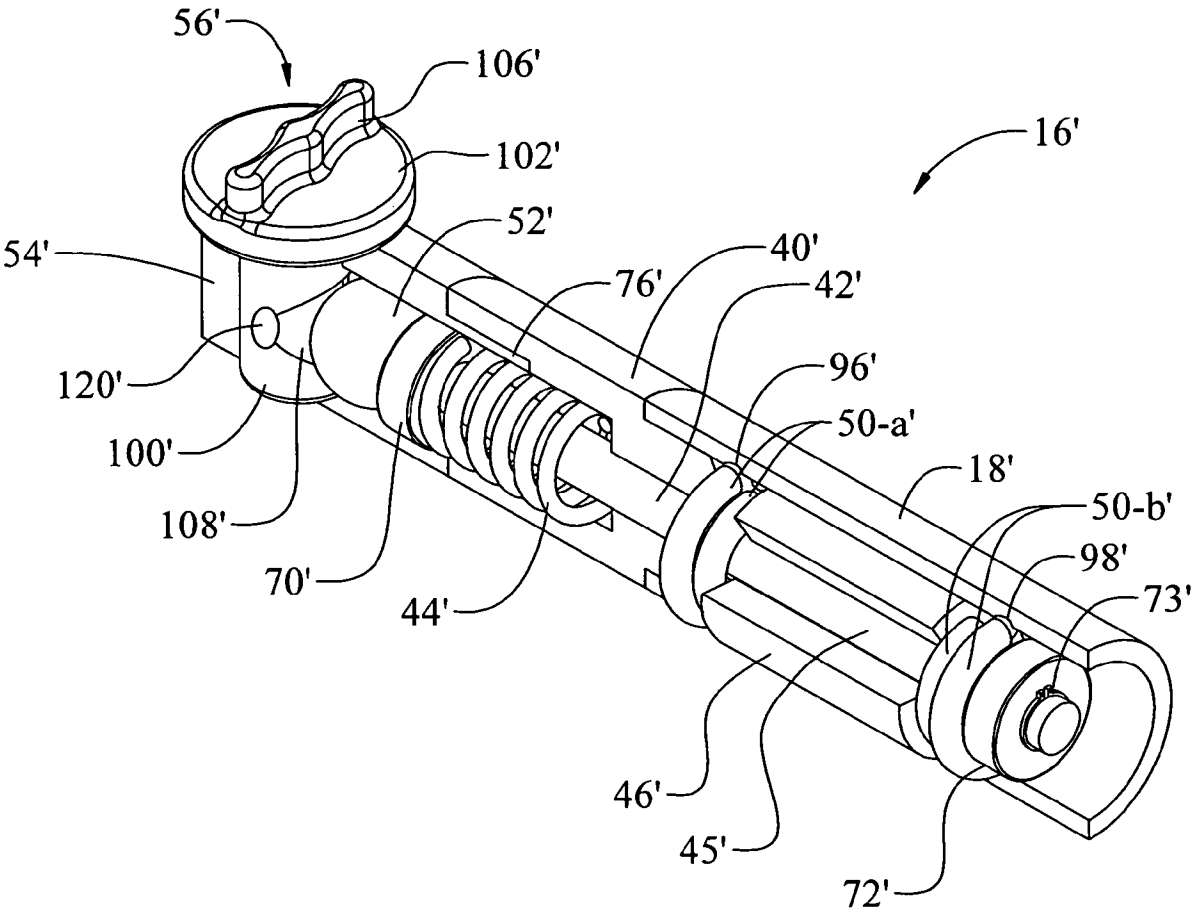
FIG. 9 is a partial cut-away perspective view of the connector of the second embodiment of the present disclosure.

An enlarged image of the connector of an alternate embedment of the present golf club disclosure is shown in FIGS. 8 and 9. The connector 16' includes a generally cylindrical body 40', a rod 42' positioned within the body 40', a biasing member comprising a compression spring 44', a bushing 46', two fasteners 50' each comprising two sets of elastic rings 50*a'* and 50*b'*, a ball bearing 52', an end plug 54' and a remote actuator 56'. The spring 44', the bushing 46', and the two fasteners 50' are all positioned about and substantially axially aligned with the rod 42'. The body 40' has a captured end Y' and an exposed end X'. A first bore 62' is formed within the body 40' that is defined by a sidewall 66' that extends through the captured end Y' of the body 40', the bore 62' having an open end and a closed end. A larger bore 64' is formed at the open end of the bore 62'. A smaller bore 68' extends from the closed end of the first bore 62' through the full length of exposed end X'. An endwall 69' is formed at the juncture between the bores 62' and 68', the endwall 69' being generally perpendicular to the axis of the bores 62' and 68'. All three bores 62', 64' and 68' are coaxial with one another and with the body 40'.

The rod 42' has two cylindrical lugs 70', 72' that are coaxial with and extend radially from the center of the rod 42'. The lugs 70', 72' form movable sidewalls for compression of the fasteners 50'. These lugs 70', 72' and the rod 42' may be formed of the same stock material, or may be formed of different pieces of material that are rigidly attached together to facilitate manufacture and assembly. In the present configuration, the lug 70' is integral with the rod 42', while the lug 72' is a separate component held onto the rod 42' with a snap ring 73'.

The connector body 40' is formed of three coaxial cylindrical segments 41', 43' and 45'. The segment 41' is sized to fit within upper shaft segment 20. In this configuration, the segment 41' constitutes the captured end of the connector 16'. The segment 43' is smaller in diameter than the segment 41' and extends from the exposed end of the segment 41', and is sized to fit within bore 19' of sleeve 18' through the mouth Z (see FIG. 5 for the embodiment). The segment 45' is smaller in diameter than the segment 43' and extends to the end of the body 40'. As can be appreciated, the bore 68' extends through the end of segment 41' and fully through both segments 43' and 45'.

The diameter of the bore 62' is slightly greater than the diameter of the lug 70'. The diameter of the bore 68' is slightly greater than the diameter of the rod 42'. The rod 42' is positioned partially within the body 40' such that the lug 70' is located within the bore 62', the rod 42' extends out of the exposed end X' of the body 40' through the bore 68', and the lug 72' is located outside the body 40' at the far end of the rod 42'. One skilled in the art will readily recognize that the rod 42' can move laterally along the length of the body 40' for a limited distance while essentially maintaining a generally coaxial relationship with the bores 62' and 68'.

The spring 44' is configured and positioned to surround the rod 42' while fitting within the bore 62' of the body 40'. The spring 44' is further sized to be under constant partial compression when within the bore 62'. The spring 44' is constrained by the lug 70' of the rod 42' at one end and the endwall 69' of the bore 62' at the other end. The end plug 54' is formed of two coaxial cylindrical portions 74' and 76', wherein the cylindrical portion 76' is smaller in diameter than the cylindrical portion 74'. A bore 78' runs through and is coaxial with the center of the cylindrical portion 76'. The diameter of the bore 78' is slightly larger than the diameter of the lug 70' such that the lug 70' may slide through the bore 78' as shown. The bore 78' continues into cylindrical portion 74' from portion 76', also as shown, and opens into a bore 80' that runs perpendicular to the bore 78' and the axis of the cylindrical portions 74' and 76'. The bore 80' extends on one end through the side of the cylindrical portion 74', but is closed within the cylindrical portion 74' at the other end of said bore. The bore 78' also houses the bearing 52', the bearing 52' being sized to fit within the bore 78' such that the bearing 52' may rotate freely within said bore with a minimal amount of horizontal or lateral freeplay.

The cylindrical portion 76' of the end plug 54' is sized to fit within the bore 64' in the body 40' where said cylindrical portion 76' is fixedly secured. The cylindrical portion 74' of the end plug 54' is sized to fit within upper shaft segment 20' where said cylindrical portion 74' is fixedly secured. Bore 84', having the same diameter as the bore 80', is formed in the side of the upper shaft segment 20' and positioned to align with the end of the bore 80' when the connector 16' is positioned within the upper shaft segment 20'.

The remote actuator 56' has a generally cylindrical stem 100' and a knob 102'. The knob 102' is positioned above the open end of the bore 80'. The knob 102' has a radial surface 104' that is larger in diameter than the diameter of the bore 80'. The knob 102' also has a protrusion 106' that rises above the surface 104' opposite the bore 80', the protrusion 106' providing a feature with which a user may turn the knob 102'. The actuator stem 100' is sized to fit rotatably within the bore 80', and extends from the base of the knob 102' through the open end of the bore 80' to the closed end of the bore 80'. A radial groove 108' is formed along the surface of the stem 100'. The groove 108' forms a partially circumferential nautilus-like channel positioned about the stem 100', such that the bearing 52' fits within and can track within the groove 108' as shown. The depth of the groove 108' varies, and in fact, rises steadily from one end of the groove 108' to the other. (See FIG. 9). Further, each end of the groove 108' has a pronounced depression 120' (See FIG. 9) shaped to accept the bearing 52' in a position of rest. Hence, as one of ordinary skill in the art will appreciate, when the knob 102' is twisted, the bearing will be forced to ride along the groove 108', under pressure from the spring 44' pressing against the lug 70'. This will force the bearing 52', the lug 70' and the rod 42' away from the actuator 56' as the groove 108' becomes more shallow, or allow the bearing 52', the lug 70' and the rod 42' to move closer to the actuator 56' as the groove 108' becomes deeper. At each end of travel for the bearing 52' along the groove 108', the bearing will come to rest within one of the pronounced depressions, to restrain the rotation of the actuator 56' as can be appreciated. Additional force will be necessary to twist the knob 102' to force the bearing 52' out of the depression and back into the main length of the groove 108' for actuation of the disclosed mechanism.

The elastic rings 50*a*'-*b*' are spring metal and have a round cross-section, but are not complete circles. (see FIGS. 6, 7). Rather, each ring 50*a*'-*b*' forms a nearly complete circle with a split or gap 92 along the circumference. This configuration allows the rings 50*a*'-*b*' to expand or contract radially under pressure, and the spring properties of the rings 50*a*'-*b*' allow them to resume their original shape once such pressure is relieved. Such rings 50*a*'-*b*' are sometimes referred to in the spring industry as coiled retaining springs, round section rings, or wire rings. In each set of the rings 50*a*'-*b*' a large and a small ring are paired together. The rings in each set 50*a*'-*b*' bear a proportionate size relationship with each other, such that the inner diameter of the larger ring is less than the outer diameter of the smaller ring, and the core diameter (i.e. the diameter of the line that runs through the core of the wire forming the ring) of the smaller ring is less than that of the larger ring. In this way, and as can be readily understood by one of ordinary skill in the art, when the rings are compressed together laterally, the larger ring expands radially while the smaller ring constricts radially. This simultaneously imparts a force through the larger ring that is perpendicular to and directed away from the rod 42' and an equal force through the smaller ring that is directed toward the rod 42'.

As can be appreciated, because the spring 44' is under constant partial compression, it constantly exerts pressure against the endwall 69' at one end and the lug 70' at the other end. The force exerted by the spring 44' is transferred through the lug 70' and through the rod 42', and causes the lug 72' to axially compress the rings 50*a*' between the endface of the cylindrical segment 43' and the bushing 46' and the rings 50*b*' between the bushing 46' and the lug 72'.

The bore 19' is sized to releasably accept the exposed end X' of the connector 16'. Grooves 96' and 98' are sized and shaped to accept the outer surface of the large rings in each of the ring sets 50*a*' and 50*b*'. When the connector 16' is slidably engaged within the sleeve 18' positioned within the lower shaft segment 24' as shown, the exposed end X' of the connector 16' will extend into the bore 19' until the upper and lower shaft segments 20' and 24' meet. The grooves 96' and 98' will then be generally aligned with the ring sets 50*a*' and 50*b*', such that when the actuator 56' is rotated to allow the ball bearing 52' to run deeper into the groove 108', thereby allowing the spring 44' to push the shaft 42' toward the actuator 56', the lug 72' will move toward the exposed end X' of the connector 16' and axially compress both sets of rings 50*a*' and 50*b*'. When the sets of rings 50*a*' and 50*b*' are axially compressed by the lug 72', the smaller ring in each set compresses against the larger ring in each set. The smaller ring is thereby forced to compress inwardly against the shaft 42', while the larger ring in each set is forced to expand outwardly into and compress against the grooves 96' and 98' respectively.

In this way, the compressive force from the spring 44' is converted into two sets of radially compressing and expanding forces at two discrete positions (through the sets of rings 50*a*' and 50*b*') along the cylindrical segment 45' within the connector 16' that firmly hold the cylindrical segment 45' to the sleeve 18' and thereby to the lower shaft segment 24'. As can be appreciated, the separation between the two sets of rings 50*a*' and 50*b*' provides a spring-loaded counterbalance along the length of the connection between the first and second shaft members 12 and 14 to minimize the wobble of the club at the connection between the shaft members during use.

This novel feature of the present disclosure distributes the load from the bias member (here, the spring 44'), among the fastening rings 50'. One of ordinary skill in the art will appreciate that this distribution minimizes the possibility of one fastener holding fast, while another fastener remains loose, which could produce an undesirable wobble during use of the club 10.

As shown in FIGS. 5 and 6 for the first embodiment, the connector 16' likewise has two wedge-shaped protrusions or locking surfaces 112' (not shown) that extend from opposite sides of the captured end Y' and onto to the exposed end X' of the connector 16'. The protrusions 112' are shaped to be received by and fit snugly within corresponding notches 114' (not shown) in the sleeve 18' (see FIGS. 5 and 6 for the first embodiment). Further, the protrusions 112' are positioned to mate with the notches 114' in such radial alignment about the central axis of the connector 16' so as to provide repeatable proper alignment the shaft member 12 with the shaft member 14 when the club 10 is fully assembled using the alternate embodiment 16', while also preventing axial rotation of the shaft member 12 relative to the shaft member 14 during use of the club 10.

Thus, as can be readily understood, when one desires to assemble this second embodiment of the golf club 10 of the present disclosure, the actuator 56' must be rotated to release the pressure on the fasteners 50' to provide sufficient clearance for the connector 16' to fit within the sleeve 18'. The exposed end X' of the connector 16' is then placed into the sleeve 18' such that the rings 50*a*' and 50*b*' align with the grooves 96' and 98', and the protrusions 112' are aligned with and inserted into the notches 114'. The actuator 56' must then rotate in the opposite direction to allow the spring 44' to compress the fasteners 50'. In this way, sets of rings 50*a*' and 50*b*' forcibly engage the outer surface of the cylindrical segment 45' with the grooves 96' and 98'. The force of the spring 44' is distributed among all the rings 50' thereby causing a very tight securing relationship, for use for golfing purposes, as can be understood. In this way, the first and second shaft members 12 and 14 can be readily and repeatably assembled to form the club 10 using the alternate embodiment 16'.

As can also be appreciated, the separation between the sets of rings 50*a*' and 50*b*' prevents, or at least minimizes, the occurrence of the wobble phenomenon between the shaft members 12 and 14 that may result, for example, from a single point contact.

To disassemble the assembled club 10, the user need only turn the actuator 56' to release the pressure on the fasteners 50'. This action disengages the exposed end X' of the connector 16' from the sleeve 18'. In this way, the first and second shaft members 12 and 14 can be readily and repeatably separated from and re-engaged with one another.

The present disclosure contemplates that only a single connector (for example, 16 or 16') is required for an entire set of golf clubs. Hence, only a single first (or upper) shaft member 12 of the clubs is required for the entire set, which can be universally accepted and interconnected with a variety of second (or lower) shaft members 14 and their integral golf club heads, whether they be for driving, iron shots, wedge shots, or for putting. The present disclosure therefore provides a desired reduction in size and weight of a golf club set when compared with conventional golf clubs. Of course, one of ordinary skill in the art will readily recognize that the present disclosure also contemplates the possibility of more than one upper shaft member in a single golf club set if so desired.

While I have described in the detailed description a variety of designs that may be encompassed within the disclosed embodiments of this disclosure, numerous other alternative configurations, that would now be apparent to one of ordinary skill in the art, may be designed and constructed within the bounds of my disclosure as set forth in the claims. Moreover, all of the above-described different releasable attaching mechanisms can be affected by a number of other and related varieties of configurations without expanding beyond the scope of my disclosure as set forth in the claims.

One of ordinary skill in the art will recognize that the present disclosure contemplates application in both separable and collapsible golf clubs. That is, in the context of the present disclosure and within the claims of the present disclosure, the term "disassembly" encompasses those configurations of a golf club in which the club is separable into more than one piece, as well as those configurations in which the golf club collapses. Such collapsing golf clubs include, for example, those configurations in which the lower shaft member is disengaged from and slides within the upper shaft member of the club.

The present disclosure is also not limited to a single biasing member. For example, the club 10 may include a separate biasing member to apply force to each of the fasteners, or the biasing member may be comprised of two or more springs or other such resilient devices. Further, the present disclosure does not require that the biasing member be limited to coil springs, but may be any variety of devices such as, for example, die springs, Belleville or disc springs, elastic bladders, pressurized pistons, or even a solid piece of elastic material, so long as the biasing member provides sufficient force to adequately compress the fasteners.

It is not necessary that the first shaft member comprise the upper shaft member, or that the second shaft member comprise the lower shaft segment. Rather, the first shaft member could comprise the lower shaft segment and the second shaft member could comprise the upper shaft segment. Further, the connector could be configured to fixedly attach to the lower shaft segment instead of the upper shaft segment. Alternatively, the connector could be configured to be releasably attached to both shaft segments.

With regard to the configuration of the sets of rings, it is not necessary that the large ring in each set be positioned in relation to the small ring as depicted in the disclosed Figures. Rather, the large and small rings in each set of rings may be positioned on either side of each other, so long as the alignment of the rings to the grooves, and any other such aligning relationships, are maintained. In addition, each of the fasteners may include more than one large ring, or alternatively, more than one small ring, or may include spacers between the rings, so long as each set includes at least one pair of large and small rings with the proportional relationship required by this disclosure such that the small ring contracts radially and the large ring expands radially when the fastener is compressed axially.

Moreover, the rings may be circular, oval or any variety of shapes. The rings may also be configured with circular, oval or any other of a variety of cross-sectional shapes. The rings also need not be limited to open coiled retaining springs, round section rings, or wire rings, having a gap. Rather, the rings may for example be solid, i.e. without the gap, if their properties, including elasticity and strength, are capable of accomplishing the engagement functions as required by the present disclosure. The rings may also be joined together, at least in part, or may be formed of a single coil having more than a single loop. For example, such rings having a double loop are commonly used as keyrings and the like.

The present disclosure is not limited to having exactly four fasteners 50 as disclosed in the first embodiment or two fasteners as disclosed in the second embodiment. Rather, additional fasteners may be included to further stabilize the connection between the first and second shaft members. As shown in the second embodiment, the benefits of the novel spring-loaded counterbalancing stability feature provided by the present disclosure can be realized with as few as two sets of rings. Further, the novel feature of the axially compressed and radially contracting and expanding rings, as disclosed herein, may be accomplished with a singe set of rings to connect the first and second shaft members.

The actuator need not be a button mechanism (as at 56) nor a knob (as at 56'), but may be any of a variety of devices such as, for example, a rocker arm, a lever, a screw, a sliding shaft, a ratchet, or any of a number of other well recognized devices, so long as the actuator can be configured to perform the functions required by the disclosure herein. Moreover, the actuator may be located at any of a number of positions along the club. For example, a lever actuator may be located at the top of the club, or along the side of the shaft. In another exarhple, a push-button attached to a lever or cam within the shaft, may operate just as effectively, and it may be arranged along the side and laterally of the shaft, for easy access and manipulation. In addition, an actuation may be accomplished through a "pulling" rather than "pushing" on the interlocking device. Further, a ratchet or a screw with a quick-release incorporated into the shaft, or at the top of the shaft, may likewise be utilized for this purpose.

Similarly, the present disclosure does not require the use of a ball bearing, which could be eliminated if the rod were to be extended to reach to the actuator so that the end of the shaft moves along the groove in the actuator. Further, other devices may be used in place of the ball bearing to reduce the friction between the rod and the actuator, such as, for example, needle bearings, bushings, a ball and socket, or a friction glide.

The sides of the end plug, the bushings, the exposed end of the connector, and the lugs, that contact any one or more of the fasteners may be vertical, beveled inward or outward, curved inward or outward, smooth, textured, or any other variety of shapes and textures, so long as they facilitate the axial compression of the fasteners as disclosed hereinabove. Such shapes and textures may be used to controllably direct the compression of the fasteners for desired purposes or in specific applications.

In addition, the connector may include grooves to accommodate O-rings or gaskets to tighten the engagement of the first and second shaft members. A cup or lip may be formed at the inner end of the sleeve to hold a pliant or elastic material, such as rubber, against which the end the connector may be pressed during engagement of the first and second shaft members to further tighten the members together.

A variety of materials may be used in the present disclosure, such as for example titanium or aluminum, having strength and light weight to provide the structural stability necessary for the device to operate properly, yet provide a reduction in weight. Where metal coil springs are disclosed in the described embodiments, alternate means for providing pressure may be used, such as for example the use of rubber and other elastic materials.

For the purposes of the spring-loaded counterbalancing feature of the present disclosure, the fasteners need not be rings as disclosed in the two embodiments of the specification, but may be other connecting devices such as for example detents, tongue and groove configurations, ratchets, buttons, latches, hooks, wedges, or any other variety of devices that are capable of being subjected to a bias and releasably connecting the first and second shaft members.

Additionally, in simpler form, the separable golf club of the present disclosure may be configured without many of the components disclosed in the embodiments herein. For example, the separable golf club may be configured with a first shaft member having a connector, a second shaft member capable of receiving the connector, and two fasteners spaced apart along the connector that are capable of releasably engaging the connector and the second shaft member. As another example, it is not necessary to the present disclosure that the club 10 have a separate connector. Rather, one of the shaft members may for example be configured to have one end that is capable of fitting within an end of the other of said shaft members, where the club of such configuration has at least two fasteners positioned between and releasably connecting said shaft members, where the fasteners are both biased either by the same or different biasing members. Such configuration may also include the expandable rings. Similarly, the present disclosure contemplates in yet another embodiment simply employing a single set of the rings to connect a first shaft member to a second shaft member.

The connector, the sleeve, the rod, and all the bores and cavities in the club, may each be cylindrical or have any variety of cross-sectional shapes, so long as the shape complements or is otherwise compatible with all other components with which it associates in the club, and does not preclude or adversely affect the operation of the club.

While it may be preferable to have grooves formed in the inner surface of the sleeve to accept and hold the fasteners, the inner surface of the sleeve may be smooth or have any variety of shapes and textures, so long as the sleeve accepts the exposed end of the connector and allows for proper operation of the fasteners to releasably connect the shaft members. For example, the texture of the inner surface of the sleeve may be roughened, or may have one or more protrusions such as a ridge or a series of ridges, a bump or a series of bumps, or one or more depressions such as a groove or series of grooves, a hole or a series of holes, or any combination of these.

Additional variations or modifications to the structure of this separable golf club may occur to those skilled in the art upon reviewing the subject matter of this disclosure. Such variations, if within the spirit of this disclosure, are intended to be encompassed within the scope of this disclosure. The description of the preferred embodiment as set forth herein, and as shown in the drawings, is provided for illustrative purposes only and, unless otherwise expressly set forth, is not intended to limit the scope of the claims, which set forth the metes and bounds of my invention.

What is claimed is:

1. A golf club comprising:

a. a first shaft member having a proximal end and a distal end, a first sidewall defining a cavity at the proximal end, the cavity having a mouth;

b. a second shaft member having a proximal end and a distal end, the proximal end configured to at least in part pass through the mouth and into the cavity, one of said first or second shaft members having a club head at its distal end;

c. a first fastener and a second fastener, both fasteners configured to releasably connect the proximal end of the second shaft member with the first sidewall of the first shaft member, the fasteners being spaced apart from one another along a longitudinal axis of the proximal end of the second shaft member to define a separation between the fasteners, the first fastener comprising a first ring positioned about the proximal end of the second shaft member, the first ring configured to expand radially to releasably engage the first sidewall; and d. a biasing member configured to exert a bias to simultaneously urge both fasteners to engage the first sidewall;

wherein when the club is assembled, the first and second fasteners provide concurrent releasable engagement between the proximal end of the second shaft member and the first sidewall, to releasably connect the first and second shaft members; the separation and the bias imparting counterbalanced engagement between the first and second shaft members.

2. The golf club of claim 1, wherein the first fastener further comprises a second ring positioned about the proximal end of the second shaft member, the second ring configured to constrict radially to releasably engage the proximal end of the second shaft member.

3. The golf club of claim 2, wherein the first and second rings are positioned adjacent one another and are configured such that the inner diameter of the first ring is less than the outer diameter of the second ring, and the core diameter of the second ring is less than that of the first ring; wherein when the first and second rings are compressed together along said longitudinal axis of the proximal end of the second shaft member, the first ring expands radially to forcibly engage the first sidewall while the second ring constricts radially to forcibly engage the proximal end of the second shaft member.

4. A golf club comprising:

a. a first shaft member having a proximal end and a distal end, a first sidewall defining a cavity at the proximal end, the cavity having a mouth;

b. a second shaft member having a proximal end and a distal end, the proximal end configured to at least in part pass through the mouth and into the cavity. one of said first or second shaft members having a club head at its distal end;

c. a first fastener and a second fastener, both fasteners configured to releasably connect the proximal end of the second shaft member with the first sidewall of the first shaft member, the fasteners being spaced apart from one another along a longitudinal axis of the proximal end of the second shaft member to define a separation between the fasteners;

d. a biasing member configured to exert a bias to simultaneously urge both fasteners to engage the first sidewall; and e. an actuator, the actuator being moveable between a first position and a second position, the first position allowing at least one of the fasteners to engage the first sidewall, and the second position restraining at least one of the fasteners from engaging the first sidewall;

wherein when the club is assembled, the first and second fasteners provide concurrent releasable engagement between the proximal end of the second shaft member and the first sidewall, to releasably connect the first and second shaft members; the separation and the bias imparting counterbalanced engagement between the first and second shaft members.

5. A golf club comprising:

a. a first shaft member having a proximal end and a distal end, a first sidewall defining a cavity at the proximal end, the cavity having a mouth;

b. a second shaft member having a proximal end and a distal end, the proximal end configured to at least in part pass through the mouth and into the cavity, one of said first or second shaft members having a club head at its distal end;

c. a first fastener and a second fastener, both fasteners configured to releasably connect the proximal end of the second shaft member with the first sidewall of the first shaft member, the fasteners being spaced apart from one another along a longitudinal axis of the proximal end of the second shaft member to define a separation between the fasteners; and d. a biasing member configured to exert a bias to simultaneously urge both fasteners to engage the first sidewall;

wherein the first sidewall is textured at least in part in proximity to at least one of said first and second fasteners when the proximal end of the second shaft member is positioned within the cavity, the first sidewall texture comprising a protrusion that is positioned between the mouth of the cavity and at least one of said first and second fasteners when the proximal end of the second shaft member is positioned within the cavity, such that when the club is assembled, the first and second fasteners provide concurrent releasable engagement between the proximal end of the second shaft member and the first sidewall, to releasably connect the first and second shaft members; the separation and the bias imparting counterbalanced engagement between the first and second shaft members.

6. The golf club of claim 5, wherein the protrusion comprises a radial ridge.

7. A golf club comprising:

a. a first shaft member having a proximal end and a distal end, a first sidewall defining a cavity at the proximal end, the cavity having a mouth;

b. a second shaft member having a proximal end and a distal end, the proximal end configured to at least in part pass through the mouth and into the cavity, one of said first or second shaft members having a club head at its distal end; and c. a first fastener comprising a first ring and a second ring, both rings positioned about the proximal end of the second shaft member between said proximal end and the first sidewall when the club is assembled, wherein the first ring is configured to expand radially to releasably engage the first sidewall and the second ring is configured to constrict radially to releasably engage the proximal end of the second shaft member, thereby releasably connecting the first and second shaft members.

8. The golf club of claim 7, wherein the first and second rings are positioned adjacent one another and are configured such that the inner diameter of the first ring is less than the outer diameter of the second ring, and the core diameter of the second ring is less than that of the first ring; wherein when the first and second rings are compressed together along the length of the proximal end of the second shaft member, the first ring expands radially to forcibly engage the first sidewall while the second ring constricts radially to forcibly engage the proximal end of the second shaft member.

9. The golf club of claim 8, further comprising a second fastener positioned between the proximal end of the second shaft member and the first sidewall, and being spaced apart from the first fastener by a separation along the length of said proximal end, both fasteners configured for concurrent releasable engagement with the first sidewall when the club is assembled.

* * * * *